US007741572B2

(12) United States Patent
Mattlar et al.

(10) Patent No.: US 7,741,572 B2
(45) Date of Patent: Jun. 22, 2010

(54) SWITCHING DEVICE MODULE

(75) Inventors: Harri Mattlar, Iskmo (FI); Rainer Kolmonen, Laihia (FI); Juho Salo, Vaasa (FI); Osmo Pikkala, Sundom (FI); Aki Suutarinen, Vaasa (FI); Jarkko Alanen, Ylihärmä (FI); Martti Tuononen, Vaasa (FI)

(73) Assignee: ABB OY, Helsinki (FI)

( * ) Notice: Subject to any disclaimer, the term of this patent is extended or adjusted under 35 U.S.C. 154(b) by 338 days.

(21) Appl. No.: 10/586,251

(22) PCT Filed: Jan. 18, 2005

(86) PCT No.: PCT/FI2005/000026

§ 371 (c)(1),
(2), (4) Date: Jun. 17, 2008

(87) PCT Pub. No.: WO2005/069333

PCT Pub. Date: Jul. 28, 2005

(65) Prior Publication Data

US 2009/0039987 A1 Feb. 12, 2009

(30) Foreign Application Priority Data

Jan. 19, 2004 (FI) ..... 20040071

(51) Int. Cl.
*H01H 1/64* (2006.01)

(52) U.S. Cl. ..... 200/50.32; 200/293

(58) Field of Classification Search ..... 200/50.32, 200/56 R, 293, 303–307
See application file for complete search history.

(56) References Cited

U.S. PATENT DOCUMENTS

| | | | | |
|---|---|---|---|---|
| 5,070,732 | A * | 12/1991 | Duncan et al. | 73/431 |
| 5,298,874 | A | 3/1994 | Morel et al. | |
| 6,452,470 | B1 * | 9/2002 | Malingowski et al. | 335/202 |
| 7,368,676 | B2 * | 5/2008 | Mattlar et al. | 200/400 |
| 2007/0063796 | A1 * | 3/2007 | Mattlar et al. | 335/6 |
| 2007/0131528 | A1 * | 6/2007 | Mattlar et al. | 200/50.21 |
| 2007/0278077 | A1 * | 12/2007 | Kolmonen et al. | 200/280 |
| 2008/0092179 | A1 * | 4/2008 | Fan et al. | 725/62 |

FOREIGN PATENT DOCUMENTS

| | | |
|---|---|---|
| EP | 0 375 568 A1 | 6/1990 |
| EP | 1 233 437 A2 | 8/2002 |
| FR | 2 787 238 A1 | 6/2000 |

* cited by examiner

*Primary Examiner*—Renee S Luebke
*Assistant Examiner*—Lisa Klaus
(74) *Attorney, Agent, or Firm*—Buchanan Ingersoll & Rooney PC

(57) ABSTRACT

A switching device module comprising a frame (2), the switching device module being adapted to be connected to another switching device module for providing a modular switching device. The frame (2) of the switching device module is provided with one or more wire troughs (8), each of which is adapted to receive at least one wire of an auxiliary circuit of said modular switching device.

16 Claims, 3 Drawing Sheets

SWITCHING DEVICE MODULE

BACKGROUND OF THE INVENTION

The invention relates to a switching device module.

Switching devices are instruments employed for opening and closing an electric circuit. Switching devices typically comprise a main shaft for controlling the poles of the switching device. Switching devices include switches and switch-fuses, for example.

A switching device assembly may comprise auxiliary circuits adapted for instance to protect and monitor the switching device. Auxiliary circuits may comprise auxiliary contacts adapted to open and close locking, alarm and position indication circuits, for example. In switch-fuses, the auxiliary circuits may comprise components associated with fuse monitoring. The auxiliary circuits are adapted to substantially lower currents than the electric circuit that the switching device is adapted to open and close.

The wires of the auxiliary circuits may pass between the switching device and the user interface equipment employed for controlling it. The wires of the auxiliary circuits may also pass for instance from one part to another part of the switching device.

The placement of the wirings of auxiliary circuits In the assembly space, such as a cubicle, of a switching device is problematic. The wires of the auxiliary circuits that pass outside the switching device take up space and make the installation untidy. The placement of the wirings of the auxiliary circuits is particularly difficult in modular switching devices composed of a plurality of interconnected switching device modules.

BRIEF DESCRIPTION OF THE INVENTION

The object of the invention is to provide a switching device module allowing the above problems to be solved. The object of the invention is achieved with a switching device module, which is characterized in what is stated in the independent claims. Preferred embodiments of the invention are described in the dependent claims.

The invention is based on providing the frame of the switching device module with wire troughs into which the wires of the auxiliary circuits can be installed.

An advantage of the switching device module of the invention is that it allows the wires of the auxiliary circuits of the switching device to be installed substantially Inside the outer sides of the switching device, whereby no space has to be reserved for the wires of the auxiliary circuits on the outside of the frame of the switching device. In addition to space saving, the switching device modules of the invention enable tidy installation of the wires of auxiliary circuits.

One or more wire troughs of the switching device module of the invention are preferably adapted such that when the switching device module is connected to another switching device module, the wire troughs of the switching device module are interconnected with one or more wire troughs of said other switching device module for drawing at least one auxiliary circuit wire from said one switching device module to said other switching device module.

BRIEF DESCRIPTION OF THE FIGURES

In the following, the invention will be described in more detail in connection with preferred embodiments with reference to the-accompanying drawings, in which.

DETAILED DESCRIPTION OF THE INVENTION

Figure 1A:
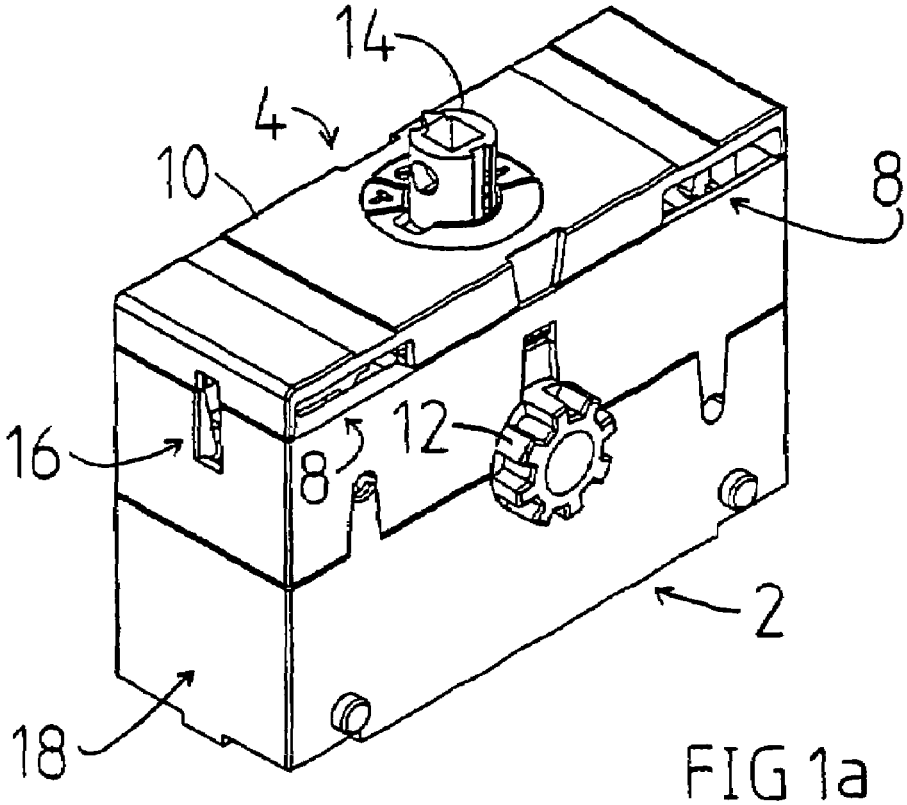
FIG. 1*a* shows the control device module according to an embodiment of the invention seen obliquely from above.

FIG. 1 shows a control device module according to an embodiment of the invention, comprising a frame 2, and a main shaft element 12 and a control shaft element 14 installed therein. The frame 2 of the control device module is substantially in the shape of a rectangular parallelepiped, i.e. box-like. The main shaft element 12 constitutes part of the main shaft of the switching device. The control shaft element 14 is adapted to turn the main shaft element 12. The control shaft element 14 is perpendicular relative to the main shaft element 12.

The control device module of FIG. 1 comprises two wire troughs 8. Both wire troughs 8 are adapted to receive a plurality of wires of the auxiliary circuits. The wire troughs 8 are placed inside planes defining the outer sides of the frame 2 of the control device module In a manner preventing the wire troughs or the wires to be installed therein from increasing the outer dimensions of the module. The wire troughs 8 extend linearly through the frame 2 in the direction of the main shaft element 12, close to the end sides 18 and 20 of the frame. In their middle portion, the wire troughs 8 also comprise transverse openings 16 enabling the withdrawal of the wires of the auxiliary circuits from the end sides 18 and 20 of the frame. The end sides 18 and 20 are parallel with the plane defined by the axes of revolution of the main shaft element 12 and the control shaft element 14.

The frame 2 comprises an openable cover part 10. The cover part 10 constitutes a cover side 4, which is an outer side of the frame 2 and perpendicular relative to the control shaft element 14. The cover part 10 provides the wall on the side of the cover side 4 of the wire troughs 8, and part of the walls on the side of the end sides 18 and 20.

The cover part 10 is adapted to be easily openable. In a preferred embodiment, the cover part 10 is adapted to be detachable without tools. When the cover part 10 is opened, the wires of the auxiliary circuits can be placed into the wire troughs 8 even if said wires were already connected at both ends to the other components of the electric circuit.

The wire troughs 8 may be interconnected in the space located below the openable cover part 10.

Figure 1B:
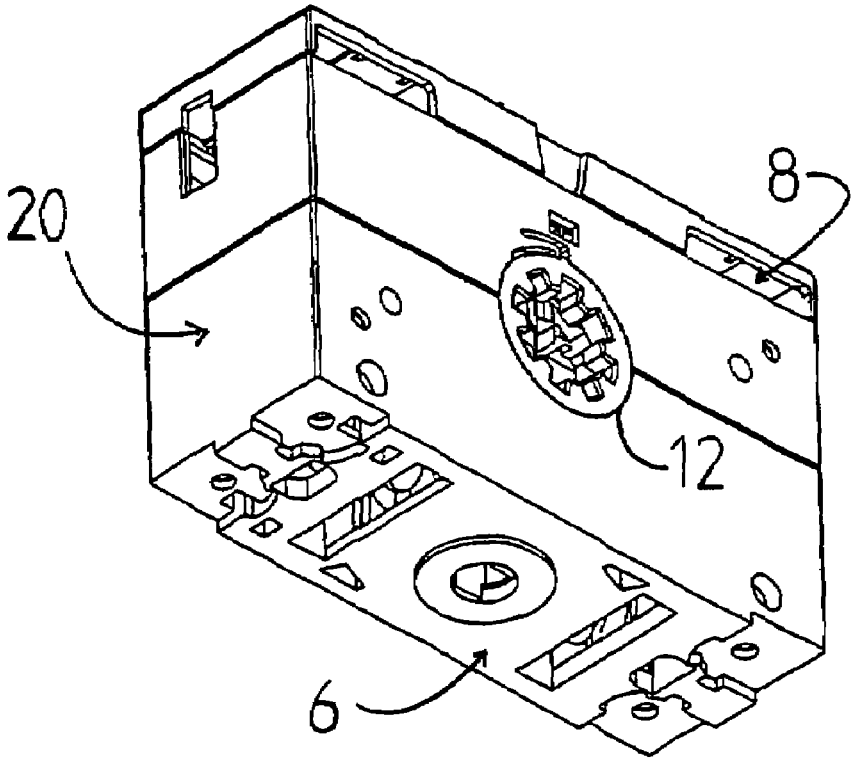
FIG. 1*b* shows the control device module of FIG. 1 seen obliquely from below.
Figure 2A:
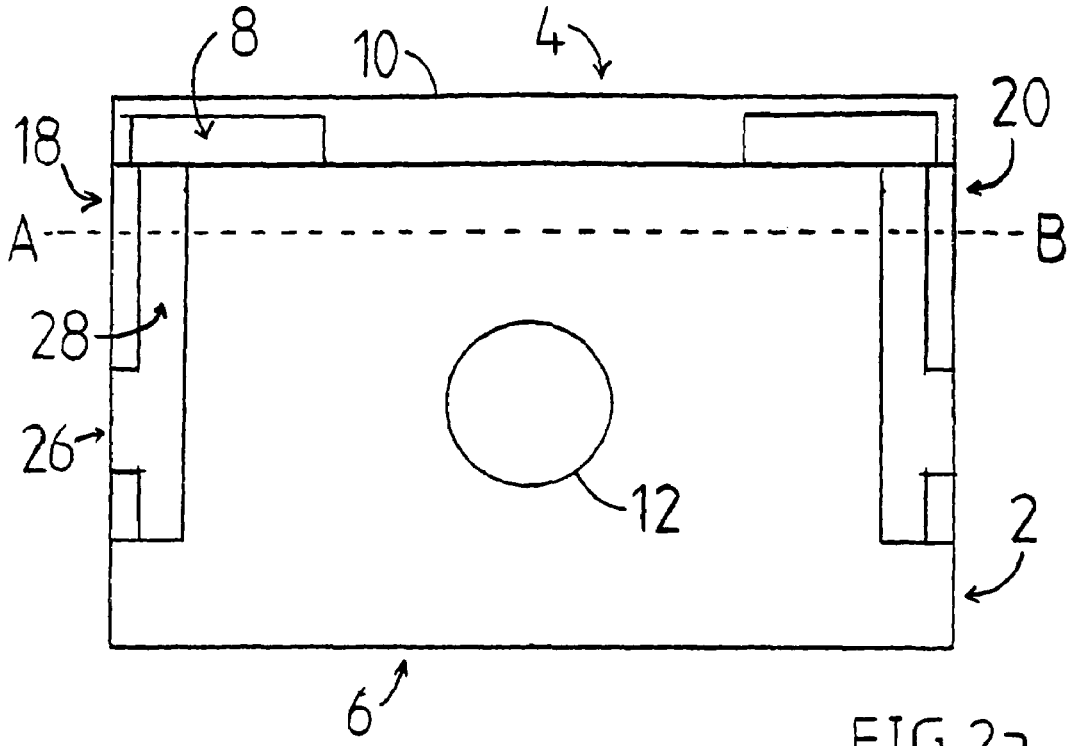
FIG. 2*a* shows a side view of the switching device module of a second embodiment of the invention.

FIG. 2*a* is a side view of a switching device module according to, the invention, which is a modification of the control device module shown in FIG. 1. Compared with the module of FIG. 1, four wire troughs 28 parallel to the control shaft element 14 have been added to the frame 2 of the control device module. In addition, the transverse openings 16 of the wire troughs 8 have been removed.

The added wire troughs 28 are located substantially at the corners of the frame 2. Each wire trough 8, parallel to the main shaft element 12, is connected to two wire troughs 28 parallel to the control shaft element 14 in a manner allowing the wire of the auxiliary circuit to pass from one wire trough to another without having to pass outside the sides of the frame 2.

The wire troughs 28 are entirely open on the side perpendicular to the main shaft element 12, and partly open on the sides facing the end sides 18 and 20. The installation of the wires of the auxiliary circuits to such open wire troughs is easy.

The wire troughs 28 are provided with transverse openings 26 enabling the withdrawal of the wires of the auxiliary circuit from the end sides 18 and 20 of the frame. These transverse openings 26 replace the transverse openings 16 in the module of FIG. 1*a*.

Figure 2B:
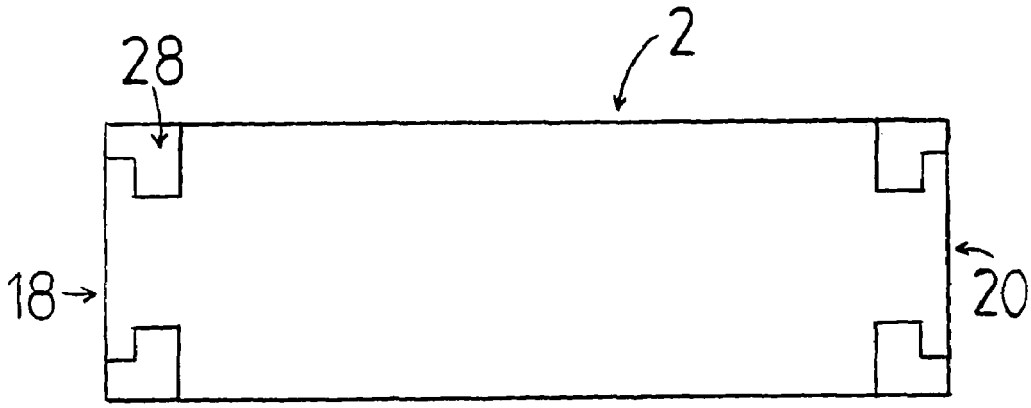
FIG. 2*b* shows a top view of the switching device module of FIG. 2*a* in section along line A-B.

The cross-section of the wire troughs 28 is shown in FIG. 2*b*, which is a top view of the switching device module of FIG. 2*a* in section along line A-B. FIG. 2*b* shows that all four wire troughs 28 have a similar cross-section.

When two switching device modules having cross-sections according to FIG. 2*b* are placed next to one another, the wire troughs 28 of adjacent modules constitute an integrated wire trough having a volume double compared with the volume of the wire trough 28 of a single module.

The control device modules of FIGS. 1*b* and 2*a* are adapted to be placed in an assembly space, such as a cubicle, in such a manner that the bottom side 6 of the module is adjacent to the wall of the assembly space. Herein, bottom side 6 refers to the side that is parallel to the cover side 4 and located opposite thereto.

The wall of the assembly space may be grounded, and it is therefore important to prevent live wires from chafing against the wall of the assembly space. In the control device module of FIG. 2*a*, the wire troughs 28 between the cover and bottom-sides do not extend up to the bottom side 6 for the aforementioned reason.

Figure 3:
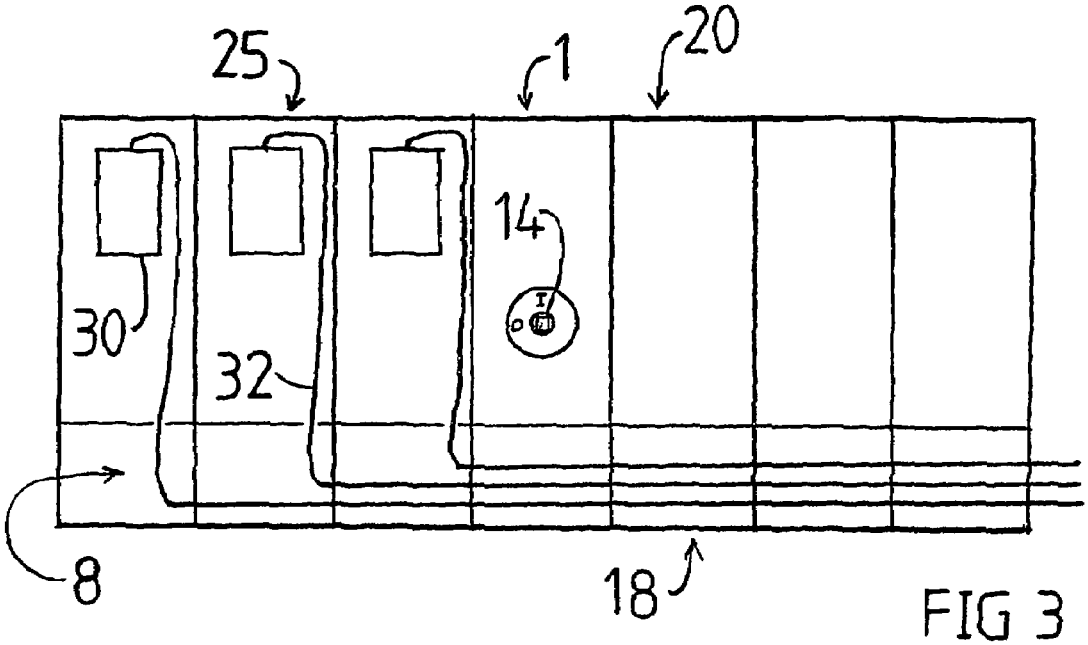
FIG. 3 shows a partly sectional view a switching device composed of switching device modules according to the invention.

A modular switching device may comprise a control device module and one or more pole cell modules connected thereto. FIG. 3 shows a switching device composed of switching device modules according to the invention and comprising a control device module 1 and six pole cell modules 25, three of which are placed on a first side of the control device module 1 when seen in the direction of the main shaft, the remaining three pole cell modules being placed on a second side of the control device module 1.

In FIG. 3, the openable cover parts of all switching device modules are detached. Tree pole cell modules 25 of the switching device comprise an auxiliary contact element 30. The auxiliary contact elements are placed below the cover part, adjacent to the end side 20. One wire 32 originates from each auxiliary contact element 30, and the wire 32 of each auxiliary contact element is drawn along wire troughs placed below the openable covers to a point at the end of the switching device, from which point said wires 32 can be drawn further to the user interface equipment. The common wire trough 8 of the wires 32 of the auxiliary circuits, along which trough the wires pass in the direction of the main shaft, is placed adjacent to the end side 18 of each module.

If the switching device modules of FIG. 3 had no interconnected wire troughs 8, the wires of the auxiliary circuits would have to pass outside the frame of the switching device every time they pass from one module to another. Similarly, if the pole cell modules 25 had no internal wire troughs between the end sides 18 and 20, the wires 32 of the auxiliary contact elements 30 would have to be drawn from adjacent the end side 20 to adjacent the end side 18 outside the module.

A modular switching device product series may comprise switching device modules having different outer dimensions. In an embodiment of the invention, the wire-troughs of the switching device modules are designed in such a manner that in a switching device composed of modules of different sizes of the same product series, the wire troughs of modules of different sizes are interconnected.

The wires of the auxiliary circuits may comprise not only wires of the auxiliary contacts and the fuse monitors but also measuring lines.

If the intention is for the switching device module to have a high enclosure class, the wire troughs may be equipped with suitable gaskets. These gaskets may comprise rubber gaskets to be mounted around wires or wire bundles. The enclosure class of the switching device module can also be improved by equipping the opening of each wire trough with a suitable stopper, which is removed only when the wire of an auxiliary circuit is to be drawn through said opening from the inside to the outside of the frame or vice versa.

It is also feasible to provide the switching device module with the openings of the wire troughs by piercing openings In the wall of the frame at points where the wires of the auxiliary circuit are to pass in said assembly. In this case, areas are preferably arranged in the frame of the switching device module, the areas being adapted for the piercing of the openings. Openings that are pierced according to the need eliminate extra openings in the frame. The same switching device module may comprise both ready-made openings and areas adapted for the piercing of openings.

The aforementioned gaskets and openings that are pierced according to the need serve to improve the protection against contact and/or splashes (IP class) of the switching device module.

It is obvious to a person skilled in the art that the basic Idea of the invention can be implemented In a variety of ways. Consequently, the invention and its embodiments are not restricted to the above examples, but may vary within the scope of the claims.

The invention claimed is:

1. A switching device module comprising a frame, the switching device module being adapted to be connected to another switching device module for providing a modular switching device, wherein the frame of the switching device module includes one or more wire troughs, each of the wire troughs being adapted to receive at least one wire of an auxiliary circuit of said modular switching device, wherein at least one of the wire troughs includes an open longitudinal side facing an exterior of the switching device module, and wherein the at least one wire trough including the open longitude side is located on a side of the switching device module that is adapted to be positioned against an adjacent switching device module.

2. A switching device module as claimed in claim 1, wherein the frame of the switching device module is substantially in the shape of a rectangular parallelepiped, and wherein the wire troughs are placed inside planes defining the parallelepiped.

3. A switching device module as claimed in claim 2, wherein the frame comprises an openable cover part, the cover part constituting at least one wall of at least one of the wire troughs.

4. A switching device module as claimed in claim 3, wherein said at least one wire of the auxiliary circuit of the modular switching device comprises a wire of a fuse monitor of a switch-fuse.

5. A switching device module as claimed in claim 3, wherein said at least one wire of the auxiliary circuit of the modular switching device comprises a wire of an auxiliary contact.

6. A switching device module as claimed in claim 1, wherein the frame comprises an openable cover part, the cover part constituting at least one wall of at least one of the wire troughs.

7. A switching device module as claimed in claim 6, comprising a main shaft element, wherein said at least one wire trough having the at least one wall constituted by the openable cover part is substantially parallel with the main shaft element.

8. A switching device module as claimed in claim 7, wherein said at least one wire trough having the at least one wall constituted by the openable cover part extends linearly through the frame.

9. A switching device module as claimed in claim 7, wherein at least one of the wire troughs extends substantially perpendicularly relative to the main shaft element.

10. A switching device module as claimed in claim 1, wherein said at least one wire of the auxiliary circuit of the modular switching device comprises a wire of a fuse monitor of a switch-fuse.

11. A switching device module as claimed in claim 10, wherein said at least one wire of the auxiliary circuit of the modular switching device comprises a wire of an auxiliary contact.

12. A switching device module as claimed in claim 1, wherein at least one wire of the auxiliary circuit of the modular switching device comprises a wire of an auxiliary contact.

13. A switching device module comprising a frame and a main shaft element, the switching device module being adapted to be connected to another switching device module for providing a modular switching device, wherein the frame of the switching device module includes one or more wire troughs, each of the wire troughs being adapted to receive at least one wire of an auxiliary circuit of said modular switching device, wherein the frame comprises an openable cover part, the cover part constituting at least one wall of at least one of the wire troughs, wherein said at least one wire trough having the at least one wall constituted by the openable cover part is substantially parallel with the main shaft element, wherein at least one of the wire troughs extends substantially perpendicularly relative to the main shaft element, wherein the switching device module comprises a cover side and a bottom side, which are substantially parallel and located opposite each other, the bottom side being adapted to be installed adjacent to a wall of an assembly space, and wherein at least one of the wire troughs extending substantially perpendicularly relative to the cover side.

14. A switching device module as claimed in claim 13, wherein at least one of the wire troughs includes an open longitudinal side facing an exterior of the switching device module.

15. A switching device module as claimed in claim 14, wherein the wire trough including the open longitude side is located on a side of the switching device module that is adapted to be positioned against an adjacent switching device module.

16. A switching device module as claimed in claim 13, wherein the at least one wire trough of the at least one wall constituted by the openable cover part extends linearly through the frame.

* * * * *